340-554 SR
3/1/88 XR 4,728,935

United States Patent [19]
Pantus et al.

[11] Patent Number: 4,728,935
[45] Date of Patent: Mar. 1, 1988

[54] INTEGRITY SECURING MONITOR AND METHOD FOR A SECURITY INSTALLATION

[75] Inventors: Math Pantus, Brunssum, Netherlands; Rolf Beckers, Burscheid, Fed. Rep. of Germany; Jo W. Haenen, Vlodrop; Jan H. Van Woezik, Helenaveen, both of Netherlands

[73] Assignee: ADT, Inc., Parsippany, N.J.

[21] Appl. No.: 850,732

[22] Filed: Apr. 11, 1986

[51] Int. Cl.[4] ..... G08B 29/00
[52] U.S. Cl. ..... 340/506; 340/522; 340/554; 340/514; 340/515
[58] Field of Search ..... 340/506, 522, 507, 508, 340/554, 531, 510, 511, 505, 514, 515

[56] References Cited

U.S. PATENT DOCUMENTS 3,641,547 2/1972 Reiss et al. ..... 340/511
3,665,443 5/1972 Galvin ..... 340/522
3,760,400 9/1973 Galvin et al. ..... 340/522
3,801,978 4/1974 Gershberg et al. ..... 340/522
3,932,870 1/1976 Shapiro et al. ..... 340/554
3,990,075 11/1976 Schmitz et al. ..... 340/511
4,006,460 2/1977 Hewitt et al. ..... 340/506
4,201,982 5/1980 Humphries ..... 340/506
4,249,166 2/1981 Schultz ..... 340/506
4,295,128 10/1981 Hashemian et al. ..... 340/506
4,482,889 11/1984 Tsuda et al. ..... 340/514
4,541,080 9/1985 Kodaira ..... 367/94
4,611,197 9/1986 Sansky ..... 340/506

*Primary Examiner*—Donnie L. Crosland
*Attorney, Agent, or Firm*—Weingarten, Schurgin, Gagnebin & Hayes

[57] ABSTRACT

The security of fire, intrusion and other security systems is improved by the disclosed monitor and method for providing an indication of the possible degradation in the integrity of a communications link and of the operability of a security sensor, both parts of the security system, and for removing the indication only in the event of a successful simulation.

13 Claims, 2 Drawing Figures

INTEGRITY SECURING MONITOR AND METHOD FOR A SECURITY INSTALLATION

FIELD OF THE INVENTION

The present invention is directed to the field of remote indication, and more particularly, to a novel integrity securing monitor and method for a security installation.

BACKGROUND OF THE INVENTION

In a typical prior-art security installation one or more security sensors are provided locally about an environment to be secured. The security sensors are responsive to such specific events as an unauthorized intrusion and smoke and/or heat to provide a signal indication of the occurence of the event. The signal is applied to an alarm means, and often indicated at a control and alarm center over a communication link. The remote center may be a police station or a central, often computerized, control unit. The communication link usually is in the form of electrical wires or, less often, some other telecommunications channel.

The functional integrity of the security installation is a condition precedent to the provision of effective countermeasures intended to circumvent or ameliorate the threat. Without an adequate notice of the occurring of the environmental event it is impossible to take responsible action to preserve life or property.

SUMMARY OF THE INVENTION

The monitor and method for securing the integrity of a security installation of the present invention includes a remote control and alarm center, one or more local security sensors for discriminating possible alarm events in the sensed environment, a communication link between the remote control and alarm center and the one or more local security sensors, contemplates means for providing a signal indication of link integrity, means for providing a signal indication of the intrinsic integrity of one or more of the parts of the one or more sensors, and further contemplates means for providing a signal indication of the functional integrity of the one or more sensors as environmental event detectors. Means are further contemplated for storing data representative of a possible degradation in the integrity either of the links, the one or more sensors as such, and in the discriminating ability of the one or more sensors. Means responsive to the data are contemplated for signaling the event degradation. Means are contemplated responsive to degradation events for re-setting the data only after insuring system operability as by the successful detection of a simulated system detectable event.

The present invention checks the integrity of the communications link and of the intrinsic and extrinsic sensor operation ability, and thus secures the security installation against system mode failures that heretofore have gone undetected. A security installation constructed in accordance with the present invention is much more reliable than heretofore possible, so that the security of property and life against loss, theft and damage is substantially improved.

In the preferred embodiment, the integrity securing monitor and method for a secure installation of the present invention includes a motion detection sub-system having a transceiver, a transducer impedance monitoring sub-system connected to the transducer for providing a signal representative of intrinsic and extrinsic transducer fault conditions, and a data latch responsive to the impedance fault signal to store a signal representative of the fault condition. Means are provided for reseting the latch only upon the successful simulation of system operation by detection of a walk-test by the motion detector.

BRIEF DESCRIPTION OF THE DRAWINGS

Other features and attendant advantages of the present invention will become apparent as the invention becomes better understood by referring to the following solely exemplary and non-limiting detailed description of the preferred embodiments thereof, and to the drawings, wherein.

DETAILED DESCRIPTION OF THE PREFERRED EMBODIMENTS

Figure 1:
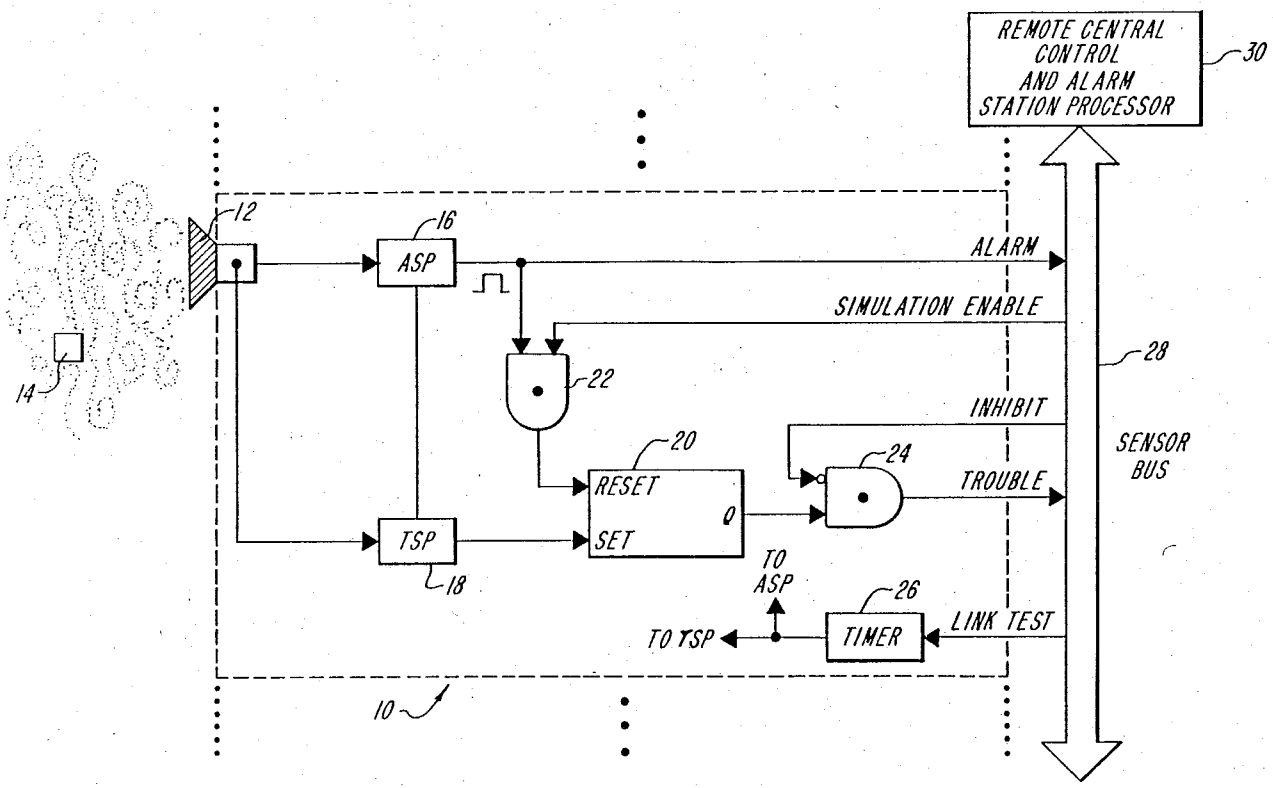
FIG. 1 is block diagram of the integrity securing monitor and method for a security installation according to the present invention.

As used herein, the term "security installation" primarily means either a fire detection or an intrusion detection system, although the present invention has utility in other types of security systems. Referring now to FIG. 1, generally designated at 10 is a block diagram of the integrity securing monitor and method for a security installation of the present invention. The monitor 10 includes a sensor 12 for sensing predetermined environment events schematically illustrated in the drawings by a box 14. An alarm signal processor 16 designated 'ASP', of any type suitable to detect the event and thereby signal an alarm, is connected to the sensor 12. A trouble signal processor 18 designated 'TSP' is connected to the sensor 12 for providing a fault or trouble signal indication of potential mechanical, electrical, and other sensor intrinsic failure states as well as sensor extrinsic functionality modes. As used herein the term "intrinsic" means the components and specific component subcooperation of the sensor and the term "extrinsic" means the specific sensor functionality. The output of the trouble signal processor 18 is connected to the set input of a data latch 20, such as a flip-flop or other memory means. The output of the alarm signal processor 16 is connected through one input of an AND gate 22 or other logic to the falling edge triggered reset input of the latch 20. The other input to the AND gate 22 is an enable signal to be described selectively provided thereto during sensor alarm function simulation. The Q output of the latch 20 is connected to one input of an AND gate 24 or other suitable logic. The other input of the AND gate 24 is a trouble inhibit signal to be described. A timer circuit 26, operatively coupled to the trouble signal processor 18 and to the alarm signal processor 16, is responsive to a test signal to be described to activate the processors 16, 18 for link integrity determinations in a manner to be described.

Sensors 12 are locally distributed about an environmental region to be secured, one being specifically illustrated for concise illustration. A bus 28 carries the alarm and trouble signals to a controller 30 and carries the enable, inhibit, and test signals provided by the controller 30 to the one or more sensors 10.

Upon the occurrence of an event capable of being sensed by the sensor 12, the processor 16 discriminates the event and provides an alarm signal to the station 30 representative of a possible threat, whereupon appropriate countermeasures may be initiated. Concurrently with alarm signal processing, the trouble signal processor 18 monitors the intrinsic and extrinsic operability of the sensor 12. In the event of an intrinsic or extrinsic fault or possible trouble in the operability or possible operability of the sensor 12, a trouble signal is produced by the trouble signal processor 18. The latch 20 latches the trouble signal in memory, and the Q output of the latch 20 produces a latched output signal. The latched output signal is passed through the gate 24, and signals the alarm station 30 of a possible trouble or fault condition with respect to the state of the sensor 12. Because the gate 20 is latched, the control unit continues to "see" the possible trouble situation, until the latch is reset, by a successful demonstration of sensor operability to be described.

The central unit 30 executes a simulation sequence to determine sensor operability and, as part of the simulation signal, applies an enable signal to the gate 22. While the enable signal is being applied, the sensor 12 is tested, manually, to determine whether or not it properly responds to the functional test situation. If it is properly operative, the ASP 16 is operative to produce a simulated alarm signal to the gate 22. The gate 22 then produces, because both its inputs are "high", a signal that resets the latch 20 to its nominal state. The Q output thereof goes "low", and the trouble signal is therewith removed.

The remote station processor is operative to produce a test signal on the sensor bus 28 to determine the communications integrity of the link 28 and included circuit portions. After a predetermined time delay, the timer 26 is operative in response to the test signal to provide ASP 16 and TSP 18 outputs that simulate alarm and trouble conditions. The processor 30 is operative, in response to the simulated alarm and trouble signals occurring appropriately time delayed on the bus 28, to determine that the link 28 and included circuit paths are appropriately functional. If no signal from one or both of the processors 16, 18 appears, or if a signal after the wrong time interval appears, on the bus 28, the processor flags a possible sensor bus failure or communications link fault condition, and appropriate correction is initiated. An inhibit signal is selectively provided on the bus 28 by the controller 30 to inhibit the trouble signal from being applied to the bus 28, for example, during the time it takes to have someone go to the location of the sensor to test its operability.

Figure 2:
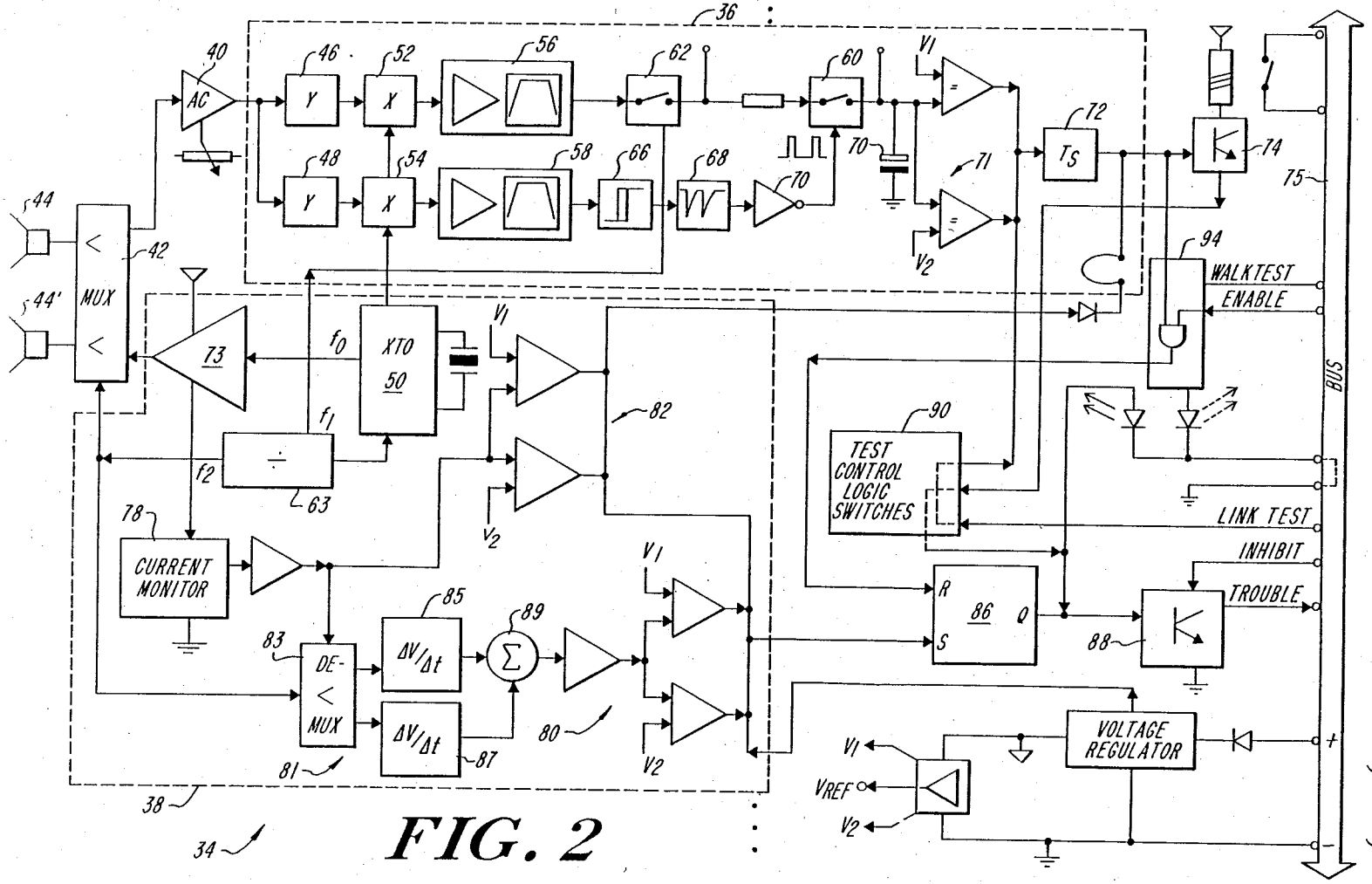
FIG. 2 is a detailed block diagram of the presently preferred embodiment of the integrity securing monitor and method for a security installation according to the present invention.

Referring now to FIG. 2, generally designated at 34 is a detailed block diagram of the presently preferred embodiment of the integrity securing monitor and method for a security installation according to the present invention. The presently preferred alarm signal processor is enclosed in a dashed box 36 and the presently preferred trouble signal processor is enclosed in a dashed box 38. The alarm signal processor 36 is connected via a variable gain amp 40 and a multiplexer 42 to two transceivers 44, 44' alternately operative as a transmitter and as a receiver. The alarm signal processor 36 includes a phase shift network 46 and a phase shift network 48 that are operative in response to the ultrasonic amplified signal produced by the amplifier 40 to provide quadrature ultrasonic detection signals. The quadrature ultrasonic detection signals are mixed with the carrier frequency signal produced by an oscillator 50 and synchronously detected to baseband by mixers 52, 54. The quadrature detected baseband signals are individually Doppler bandpass filtered by amplifier and filter circuitry 56, 58. A 90 degree phase relation subsists between the Doppler detected signals.

The Doppler quadrature signal produced by the amplifier and filter 56 is fed to sample and hold device 60 through a mute switch 62. The mute switch 62 has a duty cycle and frequency so selected by divider 63 as to mute, i.e. dis-able, beat-frequencies, at the transceiver 44, 44' on-to-off transitions, from producing false alarm signals. The other Doppler quadrature signal produced by the amplifier and filter 58 is fed to a symmetrical limiter 66, such as a Schmidt trigger then to a pulse shaper 68, and through an invertor 70 to the sample inable input of the sample and hold 60 as a Doppler synchronous pulse train output. The 90 degree phase relation is processed by the zero crossing detecting Schmidt trigger as disclosed in U.S. Pat. No. 3,760,400, incorporated herein by reference.

For true intruder motion either radially towards or away from the ultrasonic receiver, the sample and hold circuit 60 will be consistently enabled producing a corresponding one of Doppler bi-directional ultrasonic detection sub-system signals much more often statistically than random events so that the sample and hold circuit passes the charge to an integrator 70 which rapidly builds up to and trips the associated threshold of a bi-level comparator generally designated 71 coupled to the output of the integrator 70. Upon tripping the one of thresholds, a timer 72 is enabled, and after a predetermined time, the output of the timer activates the coil of a relay driver 74, and provides an alarm signal indication of intruder motion, locally, and over a bus 75 to a remote controller, not shown in FIG. 2. Reference may be had to commonly-assigned, co-pending U.S. utility patent application Ser. No. 691,156, now U.S. Pat. No. 4,625,199 incorporated herein by reference, for a reference to other U.S. patents which disclose suitable alarm signal processors, and for a further description of the operation of the alarm signal processor quadrature channels, among other things.

Acoustical trouble signalling processor 38 includes the frequency divider 63 which is coupled to the multiplexer 42. The divider controlled multiplexer is operative to repetitively switch the transducers 44, 44', alternately to the oscillator 50 and to the alarm signal processing circuit to be described in such a way that while one transceiver is in its transmit mode the other is in its receive mode, and conversely. For example, while the transceiver 44 operative as an ultrasonic receiver is operatively connected through the amplifier 40 to the alarm signal processing circuitry 36, the transceiver 44' is operative as an ultrasonic transmitter and is operatively connected to the oscillator 50 through an amplifier 73. For the next cycle of the switching signal applied to the control input of the multiplexer 42, the transceiver 44 is operative as an ultrasonic transmitter while the transceiver 44' is operative as an ultrasonic receiver. It will be appreciated that the above process continues synchronously with the output signal of the oscillator 50 as converted through the multiplexer clock output of the frequency divider 63.

Each of the transceivers 44, 44' in its transmitting mode has a characteristic electrical impedance that falls within a nominal range of values in normal operation. Such factors as pollutants and/or excessive pressure and temperature changes in the acoustic propagation medium, as well as masking attempts in the nearfield of the transceivers 44, 44', change the acoustic impedance of the propagation medium. Due to the phenomenon of transduction reciprocity, the electrical impedance of the transceivers in the transmit mode therewith changes proportionately. Moreover, such electro-mechanical failure conditions as defective vibrating membranes, piezoelectric crystals, and transducer housing cracks, among others, and such electrical failure conditions as open and short circuit conditions, likewise produce detectable changes of the characteristic electrical impedance of the transceivers 44, 44' when operating in their transmit mode. The trouble signal processor is operative to detect the changes of the characteristic electrical impedances to provide self-diagnostic alarm signals in response thereto.

A conventional current mirror circuit 78 is coupled to the oscillator 50 for providing a signal having a level that is representative of the electrical impedance of the transceivers 44, 44 respectively in their transmitting mode. The circuit 78 includes matched transistors operatively connected as a so-called current mirror, with the collector of one of the transistors connected to an output of the amplifier 73, and with the collector of the other transistor connected through a resistor to a source of constant potential. A self-diagnostic impedance is picked off between the resistor and the collector of the other transistor.

For a given preselected constant operating drive voltage for the transceivers 44, 44', any acoustically, mechanically, or electrically-induced changes in the electrical impedance of the transceivers in their transmitting mode produce correspondingly different currents into the collector of the first transistor of the current mirror. As will be readily appreciated, the current through the collector of the second transistor mirrors the current through the collector of the first transistor in the so-called current-mirror circuit, and since the voltage dropped through the resistor depends on the current through the second transistor, a voltage signal having a level representative of the electrical impedance of the transceivers 44, 44' in the transmitting mode is thereby produced. If the signal representative of the electrical impedance of the transceivers in the transmitting mode is within prescribed D.C. and A.C. bounds to be described, then both the intrinsic operation and the extrinsic operation, and hence integrity, of the sensor aspect of the security installation is in order. But if it is in an out-of-bound condition, then this is indicative of potential mechanical, electrical, acoustical, and other sources of failure and false alarm situations, a trouble signal is latched, a test procedure to be described is enabled, and only upon the successful simulation of sensor operability is the trouble indication removed.

The signal having a voltage that represents the acoustical impedance of the transceivers 44, 44' in the transmitting mode is connected, on parallel circuit legs, on the one hand to an A.C. window comparator generally designated 80 through a transducer difference compensating circuit generally designated 81, and on the other to a D.C. window comparator generally designated 82. The difference removing circuit 81 includes a demultiplexer 83 and two differentiators 85, 87, one for each of the transceivers 44, 44'. An adder 89 sums the outputs of the differentiators 85, 87. The circuit 83 keeps the channels of the transceivers separate, so that non-matched transceivers, with different characteristics, can thereby be employed without falsely indicating an out-of-bounds AC signal component possible trouble condition.

The preselected thresholds V1, V2 of the comparator 80 are selected to define the upper boundary and the lower boundary of an alternating current window for detecting out-of-bounds levels of the A.C. component of the voltage signal representative of the electrical impedance of the transceivers 12, 12' in their transmitting mode. Whenever the alternating current components of the voltage signal exceed the nominal bounds established by the thresholds, the comparator 80 is operative to produce an output signal to indicate an out-of-bounds alarm condition.

The D.C. window comparator 82 includes dual, preselected thresholds V1, V2 selected to define the upper boundary and the lower boundary of a direct current window for detecting out-of-bounds levels of the D.C. components of the signal representative of electrical impedance of the transceivers 44, 44' in the transmitting mode. The comparator 82 is operative in response to out-of-bounds D.C. signal component levels to produce output signal indication of the out-of-bounds condition.

Upon the occurrence of events detectable by the acoustic trouble processor 38, a signal is applied to the set input of a data latch 86. The Q output of the latch 86 is thereby pulsed "high", and an output indication of an electronic trouble signal is applied through a transitor switch 88 over the bus 75 to the central control processor. The events that are detectable by the acoustic trouble processor 38 include the following intrinsic and extrinsic transceiver operation and environmental items. An open circuit condition such as would be produced by a disconnection of the drive oscillator. A damaged crystal oscillator, no air pressure in the nearfield of the transceivers, excessive pollution in the propagation medium of one but not the other of the transceivers, defective vibrating membranes, piezoelectric crystals, or one or more transceiver housing defects of one of the transceivers but not of the other transceiver, atmospheric vapor condensation on the face of one transceiver but not on the other, a short-circuit condition in one transceiver but not in the other, deterioration of one transceiver due to aging and the like but not the other, excessive temperature and pressure conditions and/or excessive pollution of the propagation paths of both of the transceivers, a masking attempt, such as by cupping one of the transceivers over by hand, among others. Reference may be had to commonly-assigned co-pending U.S Utility patent application Ser. No. 691,548, now U.S. Pat. No. 4,647,913 incorporated herein by reference, for a further description of the acoustic trouble processor, and for exemplary waveforms illustrative of the operation of the acoustic trouble processor.

The integrity of the communications link is preferably monitored by the remote control unit by producing a test signal at a predetermined time, or at predetermined times, which test signal is applied to the sensor bus 75. The test signal on the bus is coupled by a switch network 90 to the alarm event timer 72. The timer 72 produces a simulated alarm signal in response to the test signal, after elaspe of its time interval, which alarm signal is applied, through the relay driver 74, to the bus 75 for transmission back to the controller. The test signal, after being selectively delayed is also switched, by the switch network 90, to the output port of the latch 86, which then triggers the trouble output drive 88, and therewith simulates a simulated trouble or fault condition signal back over the bus to the central unit at the appropriate time. As will be appreciated, the above-described test sequence does not effect the memory latch 86, the state of which is transparent to the test signal. The predetermined time delay provided by the alarm event timer 72, it will be appreciated, could be provided by any other timing means, but the alarm timer is preferably employed for this purpose to reduce overall component usage. The delay is important, insofar as the back signalling, at the appropriately delayed time, serves to confirm that the system is properly responding to the test signal. It will be appreciated that the test function, in addition to insuring the integrity of the communication link as such, also insures that that portion of the circuitry over which the test signal is applied, (that is the test logic switch 90, the alarm timer 72, the alarm relay driver 74, and electronic trouble output driver 88, in the preferred embodiment), is also operative in their intended manner.

The remote central control, in the event of its receipt of an electronic trouble signal over the sensor bus, returns an enable signal to the potentially breached unit. The enable signal is received by conventional logic 94, such as an AND gate. Responsible personnel then perform an in-the-field simulation of an alarm event, such as walk-testing the ultrasonic motion detection of subsystem. The alarm signal processor 36 is operable to produce a simulated alarm signal, which is applied to the logic 94, and together with the enable signal, drives the output of the logic 94 "high", which resets the memory latch 86 for removing the trouble indication.

The preferred embodiment is exemplary only, the principles that underlie the present invention have utility in alarm contexts employing different technology, and as will be appreciated by those skilled in the art, the present invention has wide utility in diverse fire and intrusion security systems, among others, and is not to be limited except by the scope and spirit of the claims

What is claimed is:

1. A self-secured security installation, comprising:

means including a sensor having an operative locale for providing a detection signal representative of detection of a predetermined event including a simulated predetermined event in the operative locale of the sensor if and so long as the sensor is functional;

a communication link;

means including an alarm remote from and coupled to the means including the sensor via said communication link for providing an alarm indication remote from the sensor in response to detection of the predetermined event if and only so long as the communication link is functional;

means coupled to the sensor for providing a sensor monitoring signal representative of whether or not the sensor is functional;

means coupled to the communication link for providing a link monitoring signal representative of whether or not the communication link is functional;

means including a memory individually responsive to the sensor monitoring signal and to the link monitoring signal for latching in the memory data representative of a possible dysfunction correspondingly in the sensor and in the communication link and for providing a possible dysfunction signal; and means coupled to the memory and to the means including a sensor that is operative in response to said detection signal representative of said simulated predetermined event in the operative locale of the sensor for releasing the memory and thereby removing the possible dysfunction signal.

2. The invention of claim 1, wherein said sensor has predetermined electrical performance characteristics, and wherein said signal of said sensor monitoring signal providing means is representative of whether or not the sensor meets its predetermined electrical performance characteristics.

3. The invention of claim 1, wherein said sensor has predetermined mechanical performance characteristics, and wherein said signal of said sensor monitoring signal providing means is representative of whether or not the sensor meets its predetermined mechanical performance characteristics.

4. The invention of claim 1, wherein said sensor has predetermined acoustic performance characteristics, and wherein said signal of said sensor monitoring signal providing mean is representative of whether or not the sensor meets its predetermined acoustical performance characteristics.

5. The invention of claim 1, wherein said communications link monitoring signal providing means is cyclically operative.

6. The invention of claim 5, wherein said cyclically operative communications link monitoring signal providing means includes means for cyclically sending a test signal over the communication link from the means including an alarm to the means including the sensor and for receiving a return signal from the means including a sensor to the means including an alarm, and means responsive to a predetermined characteristic of the return signal to provide said communication link monitoring signal.

7. The invention of claim 6, wherein the characteristic is a time interval.

8. A method for insuring the security of a security installation of the type having at least one local sensor having an operative locale for detection of a sensor detectable event, a remote central alarm and control unit, and a communication link therebetween, comprising the steps of:

providing a signal in response to detection of a sensor detectable event in the operative locale of the sensor;

monitoring the communication link with respect to whether or not it is functional;

monitoring the sensor with respect to whether or not it is functional;

storing a trouble indication in a memory element in the event that either the link or the sensor is dysfunctional;

generating a signal in response to detection of a simulated sensor detectable event in the operative locale of the sensor if a trouble indication has been stored; and using said signal generated in response to the simulated sensor detectable event to remove the trouble indication from the memory element because it is representative of a successful simulation of sensor functionality.

9. The invention of claim 8, wherein the sensor is a motion-responsive sensor, and said simulation includes walk-testing the sensor.

10. The invention of claim 8, wherein said storing step includes the step of storing the trouble indication as a data signal in a memory element.

11. A security installation, comprising:

a frequency source;

a transceiver having a transceiver output signal having an impedance in a transmit mode when energized by the frequency source;

means coupled to said transceiver for providing an alarm signal upon detection of doppler-components in the transceiver output signal that are representative of intruder motion and of simulated intruder motion;

means coupled to said transceiver for providing an electrical signal having a voltage representative of the impedance of the transceiver in its transmit mode when energized by the frequency source;

means responsive to the voltage for providing a trouble signal representative of possible trouble associated with the transceiver in response to whether or not the voltage meets predetermined criteria;

means including a resettable memory element responsive to the trouble signal for storing a representation of the trouble signal in the memory element; and means coupled to the alarm signal providing means operative in response to doppler components representative of said simulated intruder motion for removing the stored trouble signal representation in said memory and for resetting the resettable memory element.

12. The system of claim 11, further including means coupled to the communication link for providing a signal representative of whether or not the communications link is functional, and further including means responsive to communication link dysfunction for storing in the resettable memory element an indication thereof.

13. The system of claim 12, further including means responsive to an indication of a possible communication link integrity degradation and further responsive to a successful walk-test simulation of the function of the transceiver for removing the indication and resetting the memory element.

* * * * *